United States Patent [19]

Kohl

[11] 4,197,725

[45] Apr. 15, 1980

[54] WARP KNITTING MACHINE WITH JACQUARD ARRANGEMENT

[75] Inventor: Karl Kohl, Obertshausen, Fed. Rep. of Germany

[73] Assignee: Karl Mayer Textilmaschinenfabrik GmbH, Obertshausen, Fed. Rep. of Germany

[21] Appl. No.: 958,440

[22] Filed: Nov. 7, 1978

[30] Foreign Application Priority Data

Nov. 9, 1977 [DE] Fed. Rep. of Germany ..... 2750087

[51] Int. Cl.[2] ..... D04B 23/00; D04B 27/00

[52] U.S. Cl. ..... 66/213; 66/84 R; 66/146; 66/195

[58] Field of Search ..... 60/213, 203, 146, 125, 60/84 R, 195; 139/350

[56] References Cited

U.S. PATENT DOCUMENTS

| | | | |
|---|---|---|---|
| 3,055,196 | 9/1962 | Brunner et al. | 66/84 |
| 3,063,272 | 11/1962 | Bolton | 66/213 |
| 3,834,193 | 9/1974 | Wilkens | 66/84 R |

FOREIGN PATENT DOCUMENTS

| | | | |
|---|---|---|---|
| 408525 | 1/1925 | Fed. Rep. of Germany | 66/203 |
| 1165109 | 9/1969 | United Kingdom | 66/213 |

*Primary Examiner*—Ronald Feldbaum
*Attorney, Agent, or Firm*—Omri M. Behr

[57] ABSTRACT

A warp knitting machine which includes a jacquard mechanism to control the pattern threads utilizes the jacquard mechanism to further control a thread breaking device and a thread tensioning device thereby providing an unusual thread pattern without the aid of a conventional pull thread.

7 Claims, 9 Drawing Figures

WARP KNITTING MACHINE WITH JACQUARD ARRANGEMENT

BACKGROUND OF THE INVENTION

1. Field of the Invention

The present invention relates to warp knitting machines, and in particular to a warp knitting machine which includes a jacquard mechanism that is used to control a thread tensioning and breaking means.

2. Description of the Prior Art

Warp knitting machines known in the prior art utilized a jacquard mechanism to steer or control the pattern threads in order to produce ware having smaller or larger openings therein, such as for example, in curtain material a thread in addition to the conventional pattern thread was utilized. This commonly called pull thread is controlled by the jacquard arrangement operating in conjunction with a jacquard bar in accordance with the pre-determined pattern. In a pre-determined manner the neighboring wales were pulled together over one or more stitch rows to create the desired design. It was thus possible to obtain openings of pre-determined size with pre-determined spacings in a pre-determined sequence.

According to the prior art, this type of stitch arrangement was only obtainable when a special pull thread and at least one additional jacquard bar was utilized. The additional pull thread, which in accordance with a pre-determined pattern was used to pull together the stitch wales, could not be utilized as a pattern thread. The use of an additional thread to create the desired pattern required the use of a large amount of material and has an undesirable affect in the final ware produced. The actual amount of additional thread used was directly related to the size of the machine which produced the material.

SUMMARY OF THE INVENTION

The present invention overcomes the shortcomings found in the prior art by providing means for utilizing the pattern thread to function as a pull thread. The pattern thread is controlled by the jacquard control mechanism and varies the tension on the pattern thread as it is led through a thread brake means and a thread tensioning means both of which are controlled by a jacquard mechanism. The jacquard mechanism activates the brake means prior to activating the tension means in order that the thread wales may be pulled together as will be explained hereinafter. Moreover, utilizing the jacquard mechanism to control the thread brake and thread tensioning means is simplified by use of electromagnets associated therewith.

Furthermore, in the present system the jacquard mechanism provides for individual steering of the pattern thread as well as individual control of the braking and tensioning of the pattern thread thereby having the capability of providing a maximum number of stitch variations.

A warp knitting machine, according to the principles of the present invention, wherein the pattern threads are controlled by a jacquard mechanism comprises, in combination; thread braking means operatively coupled to and controlled by the jacquard mechanism and adapted to receive the pattern threads therethrough, the thread tensioning means being activated at prescribed intervals by the jacquard mechanism after the thread braking means.

In a warp knitting machine, according to the principles of the present invention wherein the pattern thread is controlled by a jacquard mechanism, the process of pulling together the wales of knitted goods in a predetermined pattern by utilizing only the pattern thread comprises; running the pattern thread through a braking mechanism and thread tensioning mechanism controlled by the jacquard mechanism, activating the braking mechanism prior to the activation of the tensioning mechanism at a pre-determined point along the wale to cause the pattern thread to have increased tension, and releasing the tensioning mechanism and the braking mechanism for a pre-determined number of wales before the reactivation thereof.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT

Figure 1:
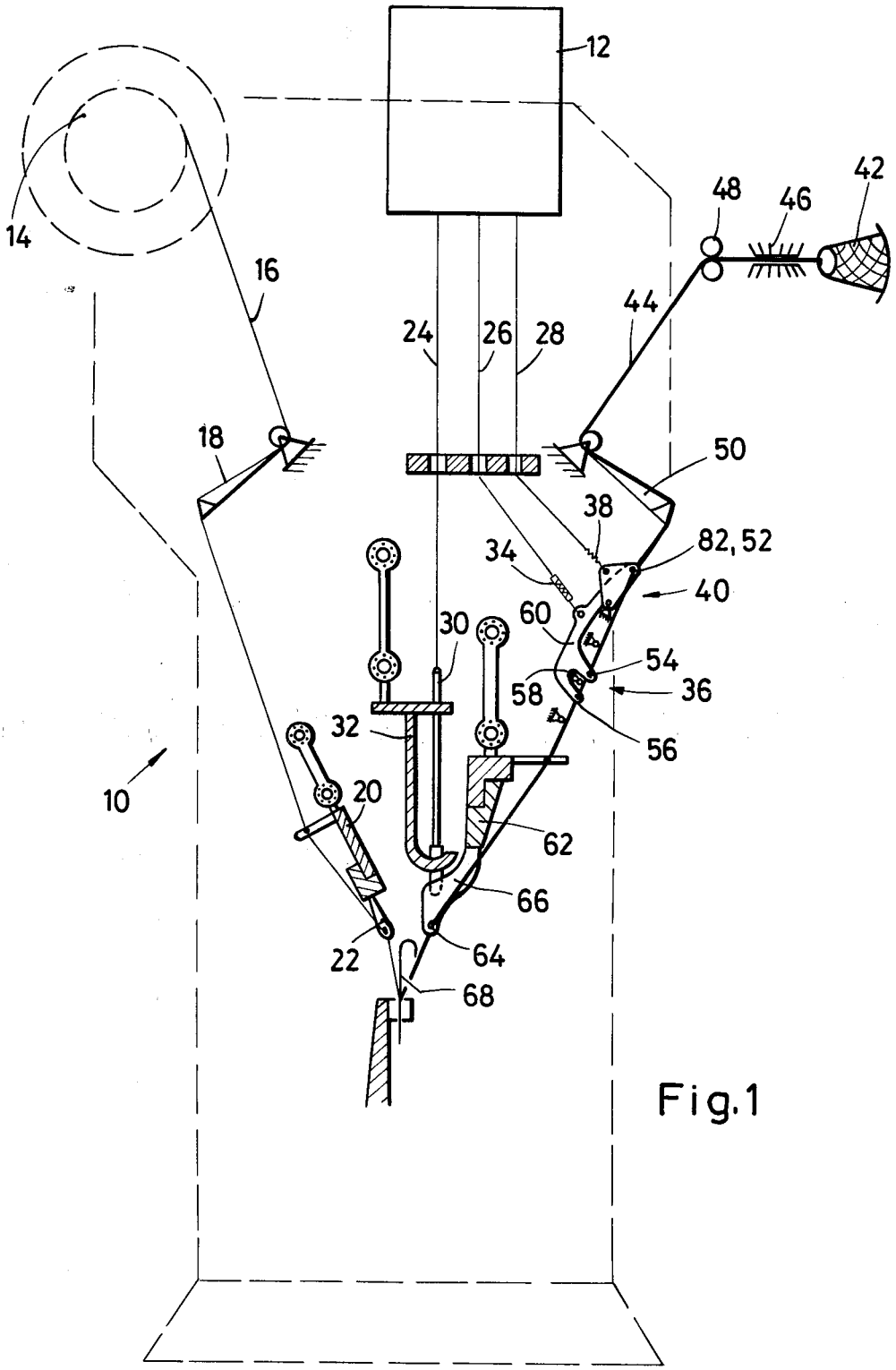
FIG. 1 is a pictorial representation of a warp knitting machine which includes a jacquard mechanism and a thread braking and thread tensioning means operatively coupled thereto, according to the principles of the present invention.

Referring now to the figures, and in particular to FIG. 1, which illustrates a warp knitting machine 10 which has disposed thereon, in a conventional manner, a jacquard mechanism 12 of the type described in U.S. Pat. No. 3,834,193 issued on Sept. 10, 1974, to C. P. Wilkens, a conventional warp beam 14 from which a ground thread 16 is pulled over a tension bar 18 to a ground thread guide bar 20 and a guide 22. Extending downwardly from the jacquard mechanism 12 are three thread harness wires 24, 26 and 28. The wire 24 is connected to a dropper 30 positioned in a dropper bar 32, in a conventional manner. The wire 26 is coupled, via an electromagnet 34, to a thread tensioning device 36. Wire 28 is coupled, via a spring 38, to a thread braking device 40. Spring 38 biases the thread braking device 40 to its open or inoperative condition. A spool 42 provides pattern thread 44 which is guided through a conventional thread brake 46, over guide rollers 48 to a tension bar 50, eyelets 52, provided in the thread braking device 40, through eyelets 54 and 56 provided in a bifurcated portion 58 of plate 60 of thread tensioning device 36, to guide bar 62, eyelets 64 of guide 66 to the needles 68 where the stitches are formed.

For convenience the pattern thread 44 is shown in a bolder line than the ground thread 16 to enable one to understand the operation of the present invention.

Figure 2:
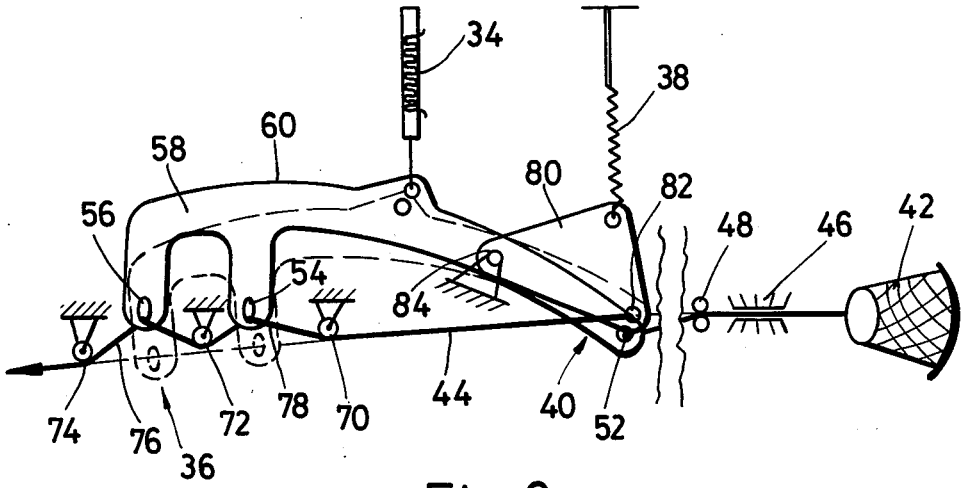
FIG. 2 is a side view in elevation of a thread braking and thread tensioning means with a pattern thread passing therethrough.

Referring now to FIG. 2 which shows an enlarged view in elevation of a thread tensioning device 36 and the thread braking device 40, according to the principles of the present invention. For ease in understanding the operation of the present invention the pattern thread 44 is shown entering the eyelet 52 provided on plate 60 of thread tensioning device 36 directly from the thread guide 28. The normal or unenergized position of the thread tension device is shown in the dotted lines of FIG. 2. When the thread tensioning device 36 is activated by means of electromagnet 34 under control of the jacquard mechanism 12, it is moved into a position shown in the solid lines of FIG. 2. The pattern thread is caused to interact with the remote pivot points or guides 70, 72 and 74 causing loops 76 and 78 to form, thereby increasing the tension on thread 44 each time a jacquard mechanism 12 activates electromatnet 34.

Spring 38 normally biases plate 80 of thread braking device 40 to its normally inoperative condition (applying no restraint to thread 44). Pattern thread 44 is fed through eyelet 82 of plate 80 as well as eyelet 52 in end plate 60. With the thread tensioning device 36 and the thread braking device 40 unactivated eyelets 52 and 82 are in line and therefore thread 44 may pass readily therethrough.

Figure 4A:
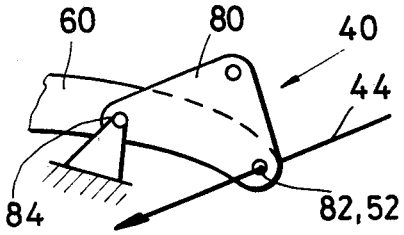
FIG. 4*a* is a partial view in elevation of a thread braking means in its unactivated position.
Figure 5A:
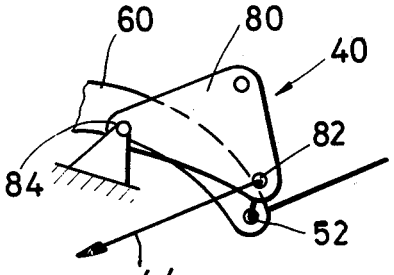
FIG. 5*a* is a partial view in elevation of a thread braking means in its activated position.
Figure 4B:
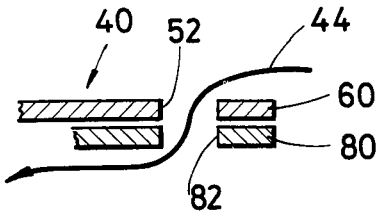
FIG. 4*b* is a partial top plan view of the thread braking means in FIG. 4*a;*
Figure 5B:
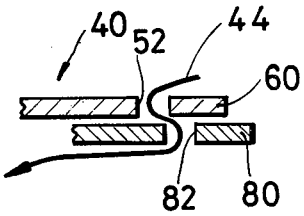
FIG. 5*b* is a partial plan view of the thread braking means shown in FIG. 5*a;*

The operation of the thread braking device is more clearly shown with reference to the FIGS. 4*a* and 4*b* which shows the braking device 40 in its unactivated condition. FIGS. 5*a* and 5*b* show the position of plates 60 and 80 when the thread braking device 40 is activated by the jacquard mechanism 12. The movement of plate 80 about pivot point 84 forces eyelets 52 and 82 to move out of alignment thereby causing additional resistance or drag to the pattern thread 44 passing therethrough.

Figure 3:
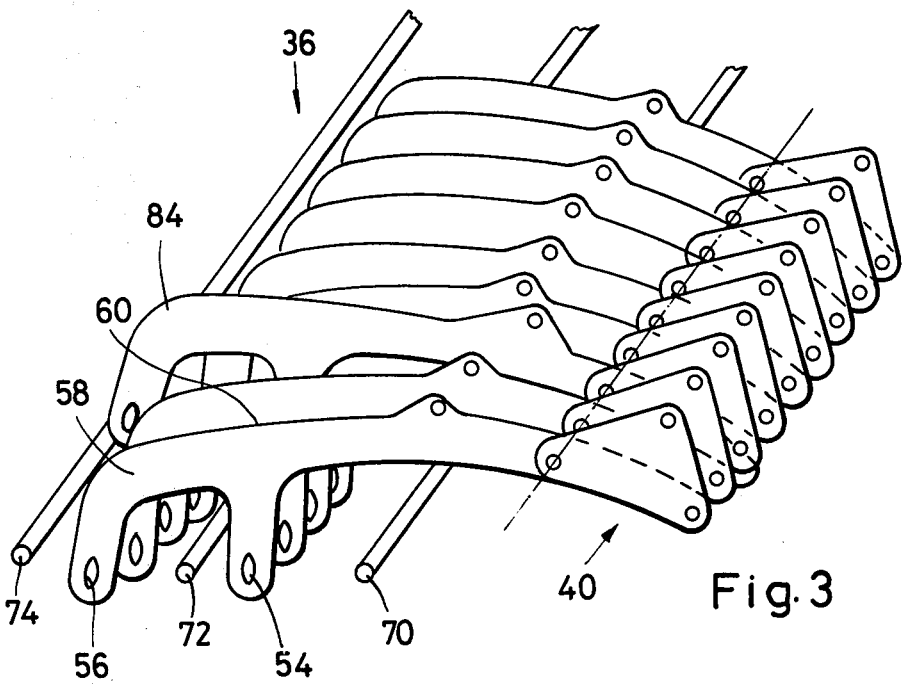
FIG. 3 is a perspective view of a plurality of thread braking and thread tensioning means according to the principles of the present invention.

FIG. 3 shows a plurality of thread tensioning devices 36 and thread braking devices 40 in tandum and adjusted to operate on a plurality of pattern threads. As shown, one tensioning device 84 has been activated by the jacquard mechanism, not shown. Movement of the thread tensioning device activated by the jacquard mechanism is performed only after the thread braking device 36 has been activated on each of the pattern threads. This enables the portion of the pattern thread in the vicinity of the needles to be tightened, its tension increased, without affecting the thread taken off the spool 42.

Figure 6A:
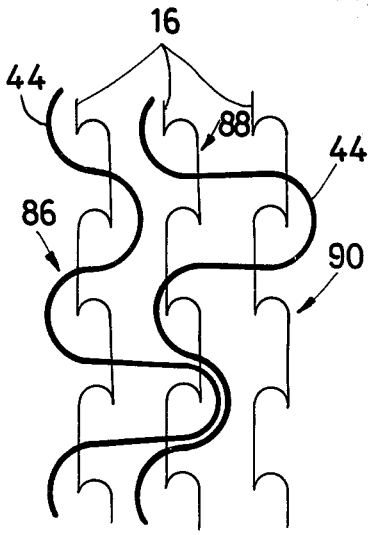
FIG. 6*a* shows the prior art stitch pattern without thread tensioning.

FIG. 6*a* discloses a conventional stitch pattern which is accomplished without any tension on the pattern thread 44.

Figure 6B:
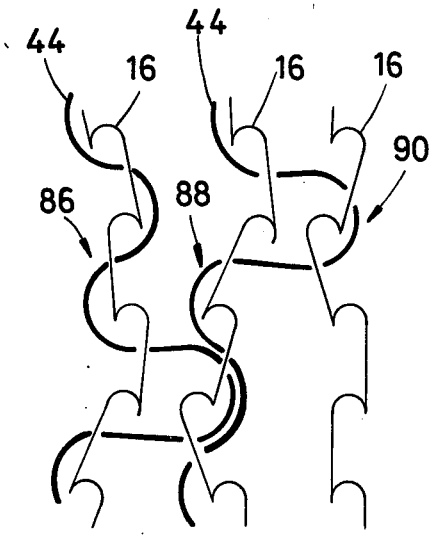
FIG. 6*b* shows the stitch pattern which provides thread tensioning, according to the principles of the present invention.

FIG. 6*b* discloses the pattern accomplished by providing thread braking and thread tensioning to the pattern thread at pre-determined intervals in the stitching cycle. The thread wales 86, 88 and 90 are drawn together as the thread brake device 40 and thread tensioning device 36 are activated by the jacquard mechanism 12.

Hereinbefore has been disclosed a warp knitting machine wherein the pattern threads are controlled by a jacquard mechanism which activates a thread braking device and thread tensioning device at various points in the knitting cycle. It will be understood that various changes in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. A warp knitting machine wherein the pattern threads are controlled by a jacquard mechanism comprising, in combination:

(a) thread braking means operatively coupled to and controlled by said jacquard mechanism and adapted to receive said pattern threads therethrough; and (b) thread tensioning means operatively coupled to and controlled by said jacquard mechanism and adapted to receive said pattern threads therethrough, said thread tensioning means being activated at prescribed intervals by said jacquard mechanism after said thread braking means.

2. A warp knitting machine according to claim 1 wherein said thread braking means comprises:

at least a pair of plates, said plates being provided with eyelets at one end thereof adapted to receive said pattern thread therethrough, and a pivot point disposed remote from said eyelets and common to said pair of plates, said jacquard mechanism causing one of said pair of plates to move about said pivot point relative to the other of said pair of plates for causing said pattern thread within said eyelets to be restrained.

3. A warp knitting machine according to claim 1 wherein said thread tensioning means comprises:

(a) a tensioning plate operatively coupled to and controlled by said jacquard mechanism, said tensioning plate being provided with a pivot point at one end thereof and at least a pair of eyelets remote from said pivot point adapted to receive said pattern thread therethrough; and (b) at least one remotely disposed tension guide, said tension guide being fixed relative to said tension plate eyelets and proximate thereto, and adapted to interact with said pattern thread and said tensioning plate when said tensioning plate is caused to move relative to said tension guide by activation of said jacquard mechanism.

4. A warp knitting machine according to claim 1 wherein said thread braking means and said thread tensioning means include a plate common to both.

5. A warp knitting machine according to claims 2 and 3 wherein said tensioning plate is one of said pair of plates and includes said tension plate pivot plate at one end thereof and said braking pivot point.

6. A warp knitting machine according to claim 1 wherein said jacquard mechanism is operatively coupled to said thread tensioning mechanism by means of an electromagnet.

7. In a warp knitting machine wherein the pattern thread is controlled by a jacquard mechanism, the process of pulling together the wales of knitted goods in a pre-determined pattern by utilizing only the pattern thread comprising:

(a) braking mechanism and thread tensioning mechanism controlled by said jacquard mechanism;

(b) activating said braking mechanism prior to the activating of said tensioning mechanism at a predetermined point along the wale to cause the pattern thread to have increased tension; and (c) releasing said tensioning mechanism and said braking mechanism for a pre-determined number of wales before the reactivation thereof.

* * * * *